US006224287B1

(12) United States Patent
Gieux

(10) Patent No.: US 6,224,287 B1
(45) Date of Patent: May 1, 2001

(54) POWDER-DISPENSING BRUSH FOR COSMETIC USE

(75) Inventor: Gérard Gieux, Paris (FR)

(73) Assignee: Cosmogen, Paris (FR)

( * ) Notice: Subject to any disclaimer, the term of this patent is extended or adjusted under 35 U.S.C. 154(b) by 0 days.

(21) Appl. No.: 09/594,488

(22) Filed: Jun. 16, 2000

(30) Foreign Application Priority Data

Jun. 18, 1999 (FR) ..... 99 07758

(51) Int. Cl.[7] ..... A46B 11/04
(52) U.S. Cl. ..... 401/282; 401/291; 15/207.2
(58) Field of Search ..... 401/282, 291, 401/270, 268, 200, 283; 15/207.2, DIG. 6, DIG. 5

(56) References Cited

U.S. PATENT DOCUMENTS 1,349,517 * 8/1920 Lukaszewski ..... 401/291
1,564,526 * 12/1925 Callais ..... 15/207.2
2,867,828 1/1959 Trutneff .
3,256,550 6/1966 Laxalt .
4,037,369 * 7/1977 Campbell ..... 51/400
4,630,954 * 12/1986 Ladd, Jr. ..... 401/270
4,944,625 7/1990 Futter et al. .
5,851,079 12/1998 Horstman et al. .

FOREIGN PATENT DOCUMENTS 4340723 6/1995 (DE) .

* cited by examiner

*Primary Examiner*—David J. Walczak
(74) *Attorney, Agent, or Firm*—Stevens, Davis, Miller & Mosher, LLP

(57) ABSTRACT

A powder-dispensing brush includes a powder reservoir, a tuft of hairs secured to the reservoir, in particular by a sleeve. The powder is caused to migrate from the reservoir into the tuft, which includes at least one group of relatively more dense hairs and one group of relatively less dense hairs. The powder is caused to migrate by at least one passage communicating with the reservoir and coming out between the groups of relatively more dense hairs and relatively less dense hairs or into the group of relatively dense hairs.

10 Claims, 1 Drawing Sheet

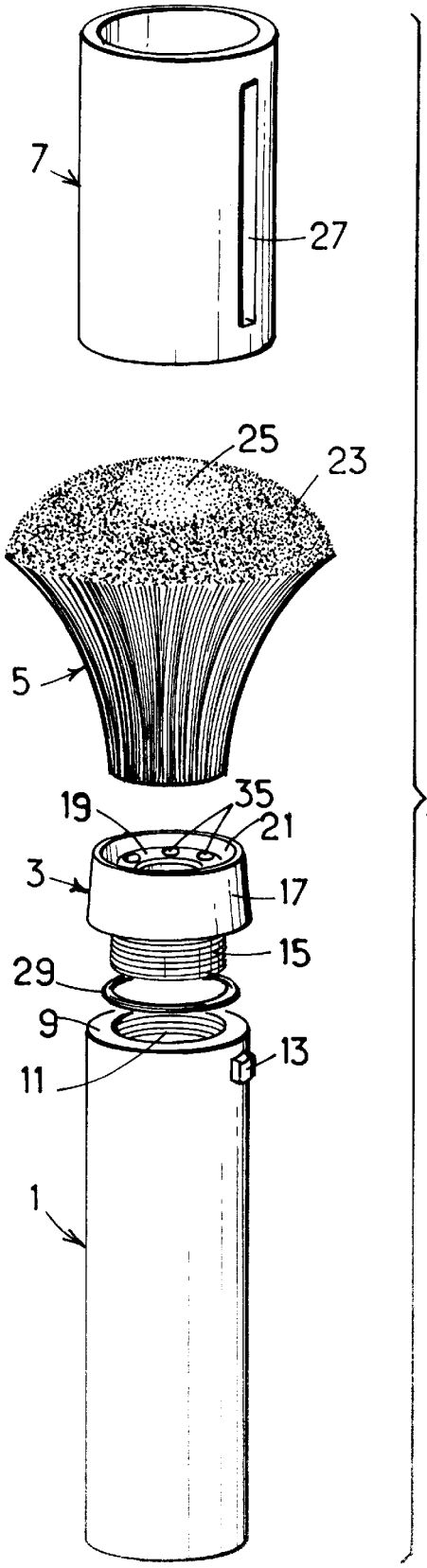
FIG.:1
FIG.:2
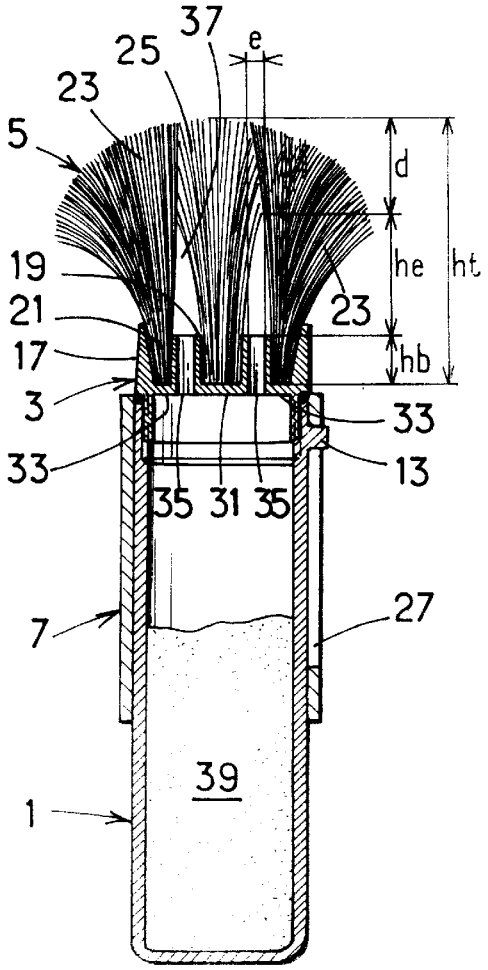

POWDER-DISPENSING BRUSH FOR COSMETIC USE

BACKGROUND OF THE INVENTION

1. Field of the invention

The present invention relates to a powder-dispensing brush for cosmetic use.

2. Description of the prior art

A powder-dispensing brush can advantageously be used to apply a cosmetic powder to the skin, metering the quantity of powder used and applying it homogeneously.

DE 43 40 723 describes a powder-dispensing brush including a powder reservoir, a tuft of hairs secured to said reservoir, in particular by a sleeve, and means for causing said powder to migrate from said reservoir into said tuft.

In the above powder-dispensing brush the tuft of hairs is in fact made of a plurality of groups of hairs and the migration means comprise a plurality of passages communicating with the reservoir and coming out between these groups of hairs.

It is found that, in use, when the tuft of hairs of this brush reaches a certain consistency, the powder has a tendency to remain trapped within the hairs of the brush, and that it is difficult to extract it without shaking the brush vigorously.

The object of the present invention is to avoid these drawbacks.

SUMMARY OF THE INVENTION

The invention achieves the above object with a powder-dispensing brush including a powder reservoir, a tuft of hairs secured to the reservoir, by a sleeve, and means for causing the powder to migrate from the reservoir into the tuft, wherein the tuft includes at least one group of relatively more dense hairs and at least one group of relatively less dense hairs and the migration-causing means include at least one passage communicating with the reservoir and coming out between the groups of relatively more dense hairs and relatively less dense hairs or into the group of relatively less dense hairs.

The above features provide a powder-dispensing brush which tuft includes relatively more dense areas which provide a satisfactory tuft consistency, and relatively less dense areas in which the powder can migrate without difficulty.

It is thereby provided a powder-dispensing brush which tuft is consistent and which doesn't have to be shaked vigorously before each use in order to extract the powder.

According to other preferred features of the powder-dispensing brush of the invention:

- the passage extends as far as the interior of the tuft to facilitate expulsion of the powder,
- the tuft includes the group of relatively more dense hairs and, at the center thereof, the group of relatively less dense hairs, and the migration-causing means include a plurality of passages disposed in a circle, communicating with the reservoir and coming out between the groups of relatively more dense hairs and relatively less dense hairs,
- the passages are formed in a hollow barrel defining with the sleeve a substantially annular groove, the group of relatively more dense hairs being disposed in the groove and the group of relatively less dense hairs being disposed at the center of the barrel,
- the migration-causing means include six passages,
- the interior of the sleeve is substantially frustoconical,

- the sleeve and the migration-causing means are molded in one piece and screwed to the reservoir,
- the groups of relatively more dense hairs and relatively less dense hairs have different colors,
- the brush includes a shroud adapted to slide on the reservoir to pack the tuft more or less tightly and to protect the tuft.

Other features and advantages of the present invention will become apparent in the light of the following description and the accompanying drawing.

BRIEF DESCRIPTION OF THE DRAWING

FIG. 1 is an exploded perspective view of a powder-dispensing brush according to the invention.

FIG. 2 is a view of the powder-dispensing brush in longitudinal section.

DETAILED DESCRIPTION OF THE PREFERRED EMBODIMENT

FIG. 1 shows that the powder-dispensing brush according to a preferred embodiment of the invention primarily includes a powder reservoir 1, a member 3 for securing a tuft of hairs 5 and an optional shroud 7.

The powder reservoir 1 can take the form of a cylinder open at one end 9 at which it has a screwthread 11.

When the optional shroud 7 is used, the powder reservoir 1 can have an outwardly directed stud 13 at its periphery.

The retaining member 3 has a screwthreaded base 15 adapted to cooperate with the screwthread 11 and on top of which is a sleeve portion 17.

Inside the sleeve is a substantially cylindrical hollow barrel 19. The hollow barrel defines with the sleeve 17 a substantially annular groove 21.

According to one essential feature of the invention, the tuft of hairs 5 has a group of relatively more dense hairs 23 and a group of relatively less dense hairs 25.

As will become more clearly apparent hereinafter, the above groups of hairs are preferably at the periphery and at the center of the tuft of hairs 5, respectively.

The shroud 7 takes the form of a thin cylindrical member whose inside diameter substantially corresponds to the outside diameter of the powder reservoir 1, apart from a slight clearance.

The shroud has a longitudinal slot 27 running virtually its entire length and whose width substantially corresponds to that of the stud 13.

The powder reservoir 1 and the retaining member 3 are preferably molded from plastics material and each of these components constitutes a single part.

The tuft of hairs 5 can use natural hairs or synthetic hairs. In one variant the relatively more dense and relatively less dense groups can have different colors or textures.

The shroud 7 can be made from metal or plastics material.

FIG. 2 shows in more detail how the component parts described above cooperate.

This figure shows that the retaining member 3 is screwed to the powder reservoir 1 by means of the screwthreads 11 and 15. A rubber gasket 29 is inserted between the two components to provide a satisfactory seal.

The hollow central part of the barrel 19 and the groove 21 have closed bottoms 31, 33 at the end facing toward the powder reservoir 1.

The group of relatively more dense hairs 23 is placed in the groove 21 and glued to the bottom 33 around the hollow barrel 19 and the group of relatively less dense hairs 25 is placed at the center of the barrel and glued to the bottom 31.

In the embodiment shown, the height hb of the barrel 19 is substantially equal to one quarter of the height ht of the tuft of hairs 5.

This height ratio is in no way limiting on the invention. For example, the height hb could be much less, and just sufficient to separate the groups of relatively more dense and relatively less dense hairs. Conversely, the barrel could extend much further into the tuft of hairs.

The lengths of the hairs are preferably chosen to confer a domed shape on the free end of the tuft 5, as shown here.

The interior of the sleeve 17 is preferably frustoconical to confer a flared shape on the tuft of hairs 5.

The hollow barrel 19 includes a plurality of channels 35 (preferably six such channels), of circular section, for example, disposed in a circle and running the entire length of the barrel.

The passages therefore communicate with the powder reservoir 1 and coming out between the groups of relatively more dense hairs 23 and the groups of relatively less dense hairs 25, in an area 37 which has a substantially conical section and in which there are no hairs.

The distance d from the area 37 in which there are no hairs to the top of the tuft 5 depends in particular on the thickness e of the hollow barrel 19, the difference between the heights hb and ht and, where applicable (see below), the packing of the tuft of hairs 5.

The shroud 7 is adapted to slide on the powder reservoir 1, the stud 13 cooperating with the slot 27.

The operation and the advantages of the powder-dispensing brush according to the invention follow directly from the preceding description.

When powder 39 in the powder reservoir 1 is to be applied to the skin, the first step is to orient the powder-dispensing brush so that the powder 39 reaches the area 37 in which there are no hairs via the passages 35.

The tuft of hairs 5 is then dabbed gently onto the skin (not shown).

Although the group of relatively more dense hairs 23 opposes a relatively high resistance to the passage of the powder 39, the group of relatively less dense hairs 25 opposes a relatively low resistance to its movement, which facilitates its expulsion toward the skin.

Clearly the flowrate at which the powder is expelled can be adjusted by varying the distance d. The greater this distance, the greater the distance over which the powder is subject to friction before it is expelled.

As previously stated, the distance d can be set during the manufacture of the powder-dispensing brush, by varying certain dimensions.

By increasing the height of the barrel, for example, for a tuft of given height and consistency the powder can be discharged nearer the free end of the tuft, which facilitates its expulsion.

According to one highly advantageous feature of the invention, the distance d can be varied for a given brush by using the shroud 7.

If the tuft of hairs 5 is sufficiently flared to extend beyond the imaginary cylinder extending the powder reservoir I (in particular because of the frustoconical shape of the interior of the sleeve 17), the tuft of hairs 5 can clearly be packed more tightly by moving the shroud 7 toward it.

In this way the height he of the area 37 in which there are no hairs can be adjusted, as it were, and consequently the distance d.

Detents can advantageously be provided on the powder reservoir 1 or on the shroud 7 to index the latter in a series of predetermined positions.

When the shroud 7 is pushed all the way toward the tuft of hairs 5 it covers it and therefore protects it when the powder-dispensing brush is not in use.

A cap (not shown) can advantageously be provided to close the shroud and to prevent powder escaping unintentionally from the brush.

The function of the relatively more dense hairs 23 is in particular to confer a satisfactory consistency on the tuft of hairs 5.

The appearance of the powder-dispensing brush can be improved by using different colors and/or textures for the groups of relatively more dense and relatively less dense hairs.

It can now be clearly understood that the present invention provides a powder-dispensing brush of very simple design which tuft includes relatively more dense areas which provide a satisfactory tuft consistency, and relatively less dense areas in which the powder can migrate without difficulty.

It is thereby provided a powder-dispensing brush which tuft is consistent and which doesn't have to be shaked vigorously before each use in order to extract the powder.

Of course, the present invention is not limited to the embodiment described and shown by way of illustrative and non-limiting example.

For example, the passages could coming out into the group of relatively less dense hairs.

Equally, the passages could be disposed in some other way than that described above, provided that they coming out between the relatively more dense and relatively less dense groups of hairs or into the group of relatively less dense hairs.

For example, the passages can be disposed in accordance with geometrical shapes other than a circle (straight line segment, triangle, square, hexagon, etc).

In one variant the passages could simply consist of holes in the bottom of the retaining member.

In another variant the passages could be formed in one or more parallel walls between groups of relatively more dense and relatively less dense hairs or in the group of relatively less dense hairs.

In another embodiment the passages could be formed in independent canulas at the interface between the groups of relatively more dense and relatively less dense hairs or in the group of relatively less dense hairs.

The tuft of hairs could equally include a plurality of groups of relatively more dense hairs alternating with a plurality of groups of relatively less dense hairs, for example in concentric circles.

The retaining member of the tuft of hairs could equally be in one piece with the powder reservoir, in which case the latter could be closed by a cap at the end opposite that incorporating the retaining member.

There is claimed:

1. A powder-dispensing brush including a powder reservoir, a tuft of hairs secured to said reservoir, and means for causing said powder to migrate from said reservoir into said tuft, wherein said tuft includes at least one group of relatively more dense hairs and at least one group of relatively less dense hairs, and said migration-causing means include at least one passage communicating with said reservoir and coming out one of (a) between said groups of relatively more dense hairs and relatively less dense hairs and (b) into said group of relatively less dense hairs.

2. The powder-dispensing brush claimed in claim 1 wherein said passage extends as far as the interior of said tuft to facilitate expulsion of said powder.

3. The powder-dispensing brush claimed in claim 2 wherein said tuft of hairs is secured to said reservoir by a sleeve and said tuft includes said group of relatively more dense hairs and, at the center thereof, said group of relatively less dense hairs, and said migration-causing means include a plurality of passages disposed in a circle, communicating with said reservoir and coming out between said groups of relatively more dense hairs and relatively less dense hairs, and wherein said passages are formed in a hollow barrel defining with said sleeve a substantially annular groove, said group of relatively more dense hairs being disposed in said groove and said group of relatively less dense hairs being disposed at the center of said barrel.

4. The powder-dispensing brush claimed in claim 1 wherein said tuft includes said group of relatively more dense hairs and, at the center thereof, said group of relatively less dense hairs, and said migration-causing means include a plurality of passages disposed in a circle, communicating with said reservoir and coming out between said groups of relatively more dense hairs and relatively less dense hairs.

5. The powder-dispensing brush claimed in claim 3 wherein said migration-causing means include six passages.

6. The powder-dispensing brush claimed in claim 1 wherein said tuft of hairs is secured to said reservoir by a sleeve and the interior of said sleeve is substantially frustoconical.

7. The powder-dispensing brush claimed in claim 1 wherein said sleeve and said migration-causing means are molded in one piece and screwed to said reservoir.

8. The powder-dispensing brush claimed in claim 1 wherein said groups of relatively more dense hairs and relatively less dense hairs have different colors.

9. The powder-dispensing brush claimed in claim 1 further including a shroud for sliding on said reservoir to pack said tuft more or less tightly and to protect said tuft.

10. The powder-dispensing brush claimed in claim 1 wherein said groups of relatively more dense hairs and relatively less dense hairs have different textures.

* * * * *